US007121048B1

(12) United States Patent
Merriman et al.

(10) Patent No.: US 7,121,048 B1
(45) Date of Patent: Oct. 17, 2006

(54) METHOD OF REMOVING A VOLUME OF FORMABLE MATERIAL

(75) Inventors: Patrick J. Merriman, Portland, OR (US); William Nicholas Merriman, Portland, OR (US)

(73) Assignee: Masons Supply Company, Portland, OR (US)

( * ) Notice: Subject to any disclaimer, the term of this patent is extended or adjusted under 35 U.S.C. 154(b) by 0 days.

(21) Appl. No.: 11/316,491

(22) Filed: Dec. 21, 2005

Related U.S. Application Data

(62) Division of application No. 10/810,015, filed on Mar. 26, 2004, now Pat. No. 7,000,361.

(51) Int. Cl.
*E04B 1/00* (2006.01)

(52) U.S. Cl. ..... 52/127.3; 52/741.12; 52/DIG. 1

(58) Field of Classification Search ..... 52/741.1, 52/749.1, DIG. 1, 749.14, 741.12, 127.3, 52/127.4, 747.12
See application file for complete search history.

(56) References Cited

U.S. PATENT DOCUMENTS 3,273,930 A * 9/1966 Gottfried ..... 111/101
4,938,201 A * 7/1990 Chiuminatta et al. .... 125/13.01
5,826,668 A * 10/1998 Kosmalski ..... 172/19

FOREIGN PATENT DOCUMENTS

FR 2231182 A * 1/1975 ..... 172/19

* cited by examiner

*Primary Examiner*—Naoko Slack
(74) *Attorney, Agent, or Firm*—Law Office of Timothy E. Siegel; Timothy E. Siegel

(57) ABSTRACT

A method of removing a predetermined area and depth of formable material from an expanse of the formable material having a top surface. The method makes use of a volume indicating tool that includes a depth indicator that has a material surface indicator and a depth guide. The material surface indicator is at a height above the depth guide substantially equal to the predetermined depth. The volume indicating also includes an area indicator, indicating an area equal to the predetermined area. The volume indicating tool is pushed into the formable material until the material surface indicator is level with the top surface of the formable material, thereby pushing the depth guide to the predetermined depth. Then a shovel is pushed into the deformable material until it reaches the depth of the depth guide and is used to gather formable material. The shovel is emptied at a location away from the shovel guide tool. The shoveling process is continued until the area indicated by the area indicator is cleared of formable material down to the depth guide.

3 Claims, 3 Drawing Sheets

METHOD OF REMOVING A VOLUME OF FORMABLE MATERIAL

RELATED APPLICATIONS

The present patent application is a division of U.S. application Ser. No. 10/810,015 filed Mar. 26, 2004 now U.S. Pat. No. 7,000,361.

BACKGROUND OF THE INVENTION

The present invention relates to the removal of formable material.

The technology for providing concrete paving that has surface features has become an important field of endeavor with the advent of Americans with Disabilities Act (ADA) current guidelines requirement for detectable warnings on walking surfaces. These detectable warnings must be a grid of raised truncated domes with a diameter of 23 mm (0.9 in) at the base and 10 mm (0.4 in) at the top, a height of 5 mm (0.2 in) and a center-to-center spacing between nearest neighbors of 60 mm (2.35 in).

A number of different technologies have evolved to create the detectable warnings. First there is a polymer molded product that is about 5 mm (0.1875 in) thick and is provided in the form of tiles having flanges that extend downwardly by 3.5 cm (1.375 in). To install this product, the flanges are pressed into wet concrete. This material is light, and therefore easy to bring to the worksite. It may form a strong bond with the concrete that it is applied onto. Moreover, the fact that it is applied onto wet concrete is a great advantage, as it can be applied at the same time as the concrete is poured, unlike some other methods that are described below. The general term for this type of product is a "wet set" plastic tile.

A number of other surface feature-bearing elements exist, including precast concrete blocks, on the order of 5 cm (2 in) thick, brick pavers, glue down plastic elements, glue down rubber mat and hot applied mat. Unfortunately, for each one of these options, the installer must first pour a concrete substrate, wait 28 days for the concrete to thoroughly set, and then return to apply the surface feature bearing elements. This has been heretofore necessary for any product that had a thickness of more than a few millimeters, as the surface bearing element would otherwise protrude upwardly above the surrounding surface. Precast concrete blocks have had the particular problem that they are so heavy that if set into wet concrete such a block would press down so heavily as to push the wet concrete up around the sides of the concrete block. Any glue down product must be adhered to a finished substrate in order to gain a strong adhesion. Moreover, brick pavers must be laid on an even finished surface. Because they are supported by a substrate that is already solid at the time of installation, all of these products tend to have substantially planar bottom surfaces.

In a separate sequence of developments, prestressed concrete has been available for many years, with improvements gradually being made to the production process and the resultant product. A relatively recent advancement is described in U.S. Patent Application Publication 2002/0059768 ("the application"), which is incorporated by reference as if fully set forth herein. The application describes a method for producing a thin, lightweight prestressed concrete panel by balancing the tendons about a center plane of the panel. There appears to be no suggestion in the application that the panels thereby produced could be beneficially used as paving tiles.

Moreover, at first assessment, it would seem to many of those familiar with the technology of concrete installations that the use of this type of panel for paving would be limited to applications in which a substrate of cured concrete first must be provided. This appears to be how the previously available concrete blocks and all of the adhered paving elements have been installed. Moreover, the added expense of using prestressed concrete for applications in which there is not a structural requirement to do so, would not appear practical.

SUMMARY OF THE INVENTION

In one aspect, the present invention is a method of removing a predetermined area and depth of formable material from an expanse of the formable material having a top surface. The method makes use of a volume indicating tool that includes a depth indicator that has a material surface indicator and a depth guide. The material surface indicator is at a height above the depth guide substantially equal to the predetermined depth. The volume indicating also includes an area indicator, indicating an area equal to the predetermined area. The volume indicating tool is pushed into the formable material until the material surface indicator is level with the top surface of the formable material, thereby pushing the depth guide to the predetermined depth. Then a shovel is pushed into the deformable material until it reaches the depth of the depth guide and is used to gather formable material. The shovel is emptied at a location away from the shovel guide tool. The shoveling process is continued until the area indicated by the area indicator is cleared of formable material down to the depth guide.

The foregoing and other objectives, features and advantages of the invention will be more readily understood upon consideration of the following detailed description of the preferred embodiment(s), taken in conjunction with the accompanying drawings.

DETAILED DESCRIPTION OF THE PREFERRED EMBODIMENTS

Figure 1:
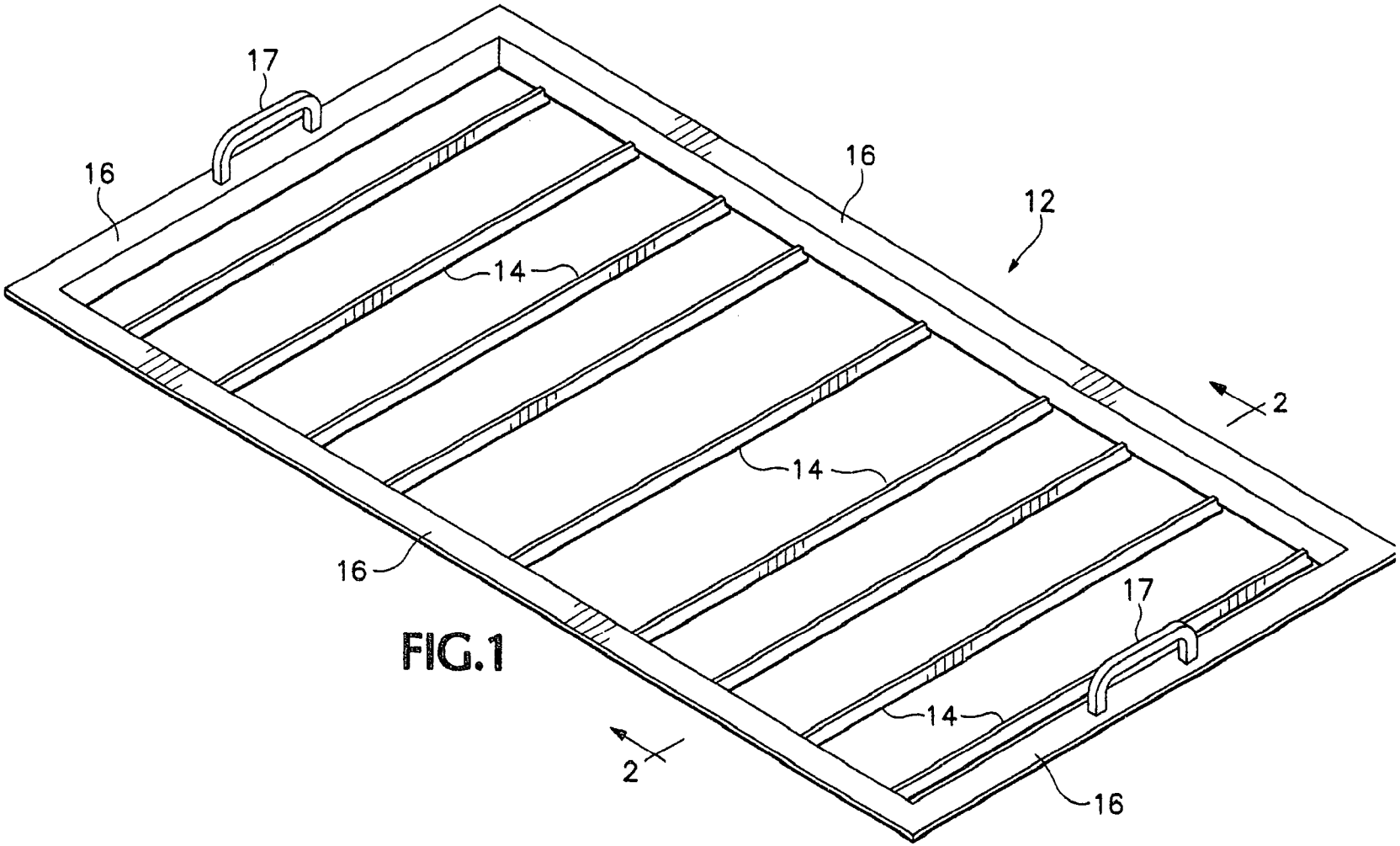
FIG. 1 is a perspective view of a shovel guide tool according to a preferred embodiment of the present invention.
Figure 2:
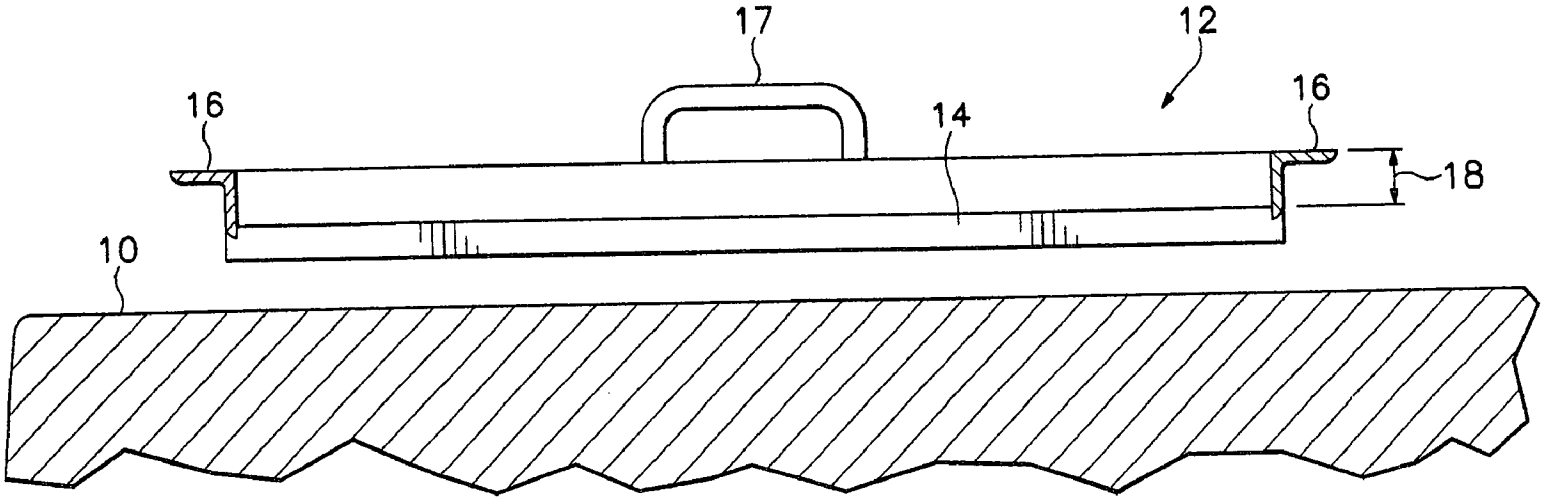
FIG. 2 is a side of the shovel guide tool of FIG. 1 being positioned above an expanse of formable material, according to a step of a preferred method of the present invention.
Figure 3:
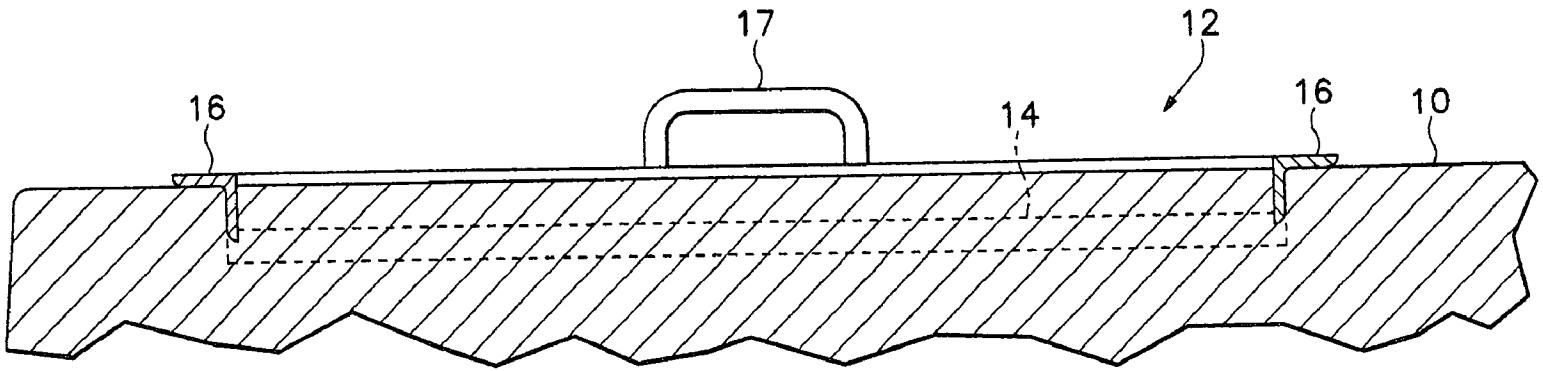
FIG. 3 is a side view of the elements shown in FIG. 2 with the shovel guide tool pressed into the formable material, according to a further step of a preferred method of the present invention.
Figure 4:
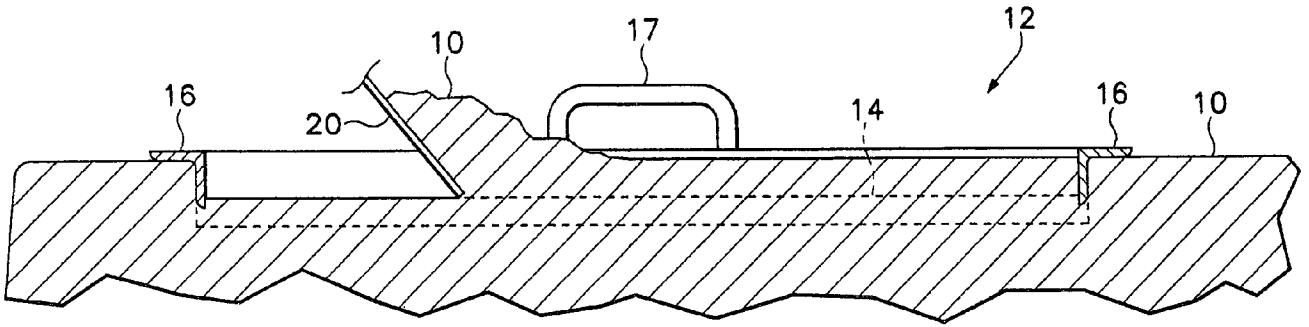
FIG. 4 is a side view of the elements of FIG. 3, also showing a shovel being moved along the shovel guide tool, according to a further step of the preferred method of the present invention.
Figure 5:
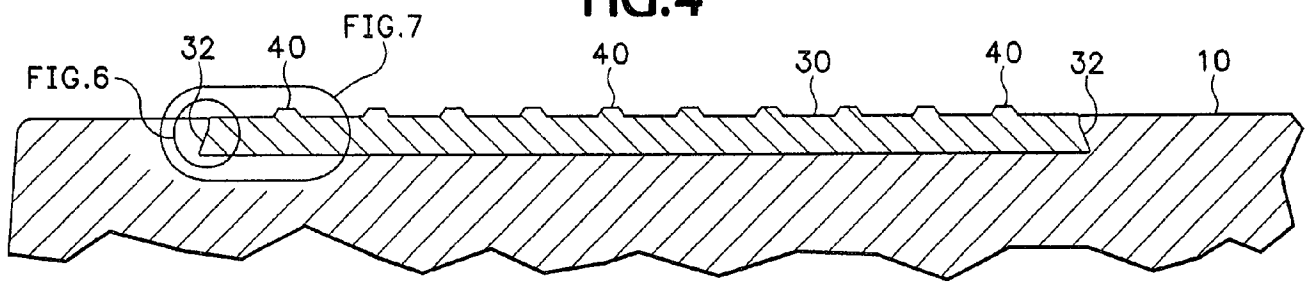
FIG. 5 is a side view of a finished concrete installation, which may be a result of the method partially shown in FIGS. 2, 3 and 4 and is in itself a preferred embodiment of the present invention.

A first preferred method of the present invention is a method of removing a predetermined area and depth of wet concrete (FIG. 2), or other formable material, from an expanse of the wet concrete 10. This is most typically done for the purpose of setting a tile of matching area and thickness (see below). This method makes use of a shovel guide tool 12, comprising a set of shovel guides 14, in the form of ribs. A depth and area indicator 16, is in the form of a rectangular frame having handles 17. Indicator 16 has a bottom surface that is at a height 18 (FIG. 2) above the tops of shovel guides 14 that is substantially equal to the predetermined depth. The shovel guide tool 12 is pushed into the wet concrete 10 until the bottom surface of the depth indicator 16 is level with the top surface of the wet concrete 10, thereby pushing the top surface of the shovel guides 14 to the predetermined depth.

A shovel 20 is pushed into the wet concrete until it encounters the top surfaces of the shovel guides 14 and is run along these top surfaces until it is at least partially filled with wet concrete 10. The shovel 20 is emptied at a location away from the shovel guide tool 12. The shoveling process is continued until the area indicated by the area indicator 16 is cleared of wet concrete 10 down to the top surfaces of the shovel guides 14.

At this point a depression of predetermined depth and area has been created in the wet concrete. In a preferred embodiment guide tool 12 is constructed to create a depression of exactly the right area and depth to accommodate a concrete tile 30. Tile 30 may have a width of about 0.6 meters (approximately 2 feet) and may be either about 0.6, 0.75 or 0.9 meters (approximately 2, 2.5, or 3 feet) long. In a preferred method a 3 mm (⅛ in) coat of mortar is applied to the bottom of tile 30 immediately prior to installation. Tile 30 is then placed into the depression created and concrete 10 is compacted and finished about it. Additional wet concrete 10 may be added to help retain a set of wedge sections 32 of tile 30.

Figure 7:
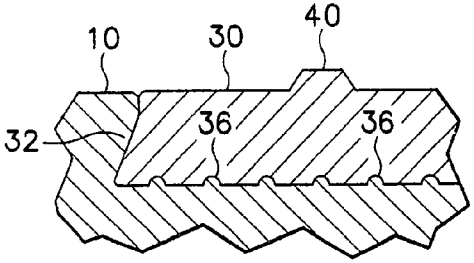
FIG. 7 is a partial side view of the finished concrete installation of FIG. 5, which is enlarged relative to FIG. 5.
Figure 6:
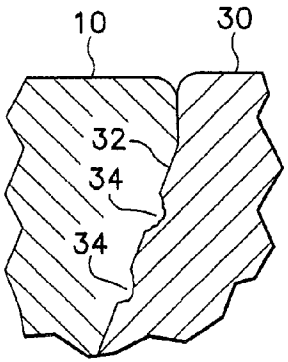
FIG. 6 is a greatly enlarged partial side view of the finished concrete installation of FIG. 5.

The above described process creates a structure in which tile 30 is supported from the bottom and contacted on the sides by wet concrete 10. After concrete 10 has cured, this structure is set, with tile 30 being similarly supported and contacted by cured concrete. In a preferred embodiment, tile 30 defines pores 34 (FIG. 6), some of which are at least partially filled with concrete 10. Also, the bottom surface of tile 30 is indented with a set of furrows 36 (FIG. 7) that facilitate the formation of an interlocked bond with the underlying concrete 10. The structure created, in which tile 30 is supported and held in place by surrounding concrete 10 is of particular strength. Moreover, it is very resilient to compression and shear, as may be encountered by a concrete installation when trucks either pass by the installation or pass at least partially over the installation.

Tile 30 may have surface features, such as a grid of truncated domes 40. As noted in the background section, domes 40 serve as detectable warnings, and are mandated by the ADA guidelines for various installations including curb cuts, train station platforms, hazardous vehicular crossings and reflecting pool edges. In some instances a grid having a width of 0.9 meter (@ 3 ft) is required, instead of the standard 0.6 meters (@ 2 ft). Under the current guidelines, domes 40 must have a diameter of 23 mm (0.9 in) at the top and 10 mm (0.4 in) at the top, a height of 5 mm (0.2 in) and a center-to-center spacing of 60 mm (2.35 in) between nearest neighbors. Tiles, similar to tile 30, may be used for other purposes. Among these are adding strength to a concrete paved area; adding a colorful design to an area; adding artistic surface protrusions; and having a set of surface features or a surface shape that facilitates water drainage.

In one preferred embodiment, tile 30 is of a make generally described in U.S. Patent Application Publication 2002/0059768, which has been incorporated by reference. In an alternative preferred embodiment a concrete paving tile of a differing construction is used. In one preferred embodiment a set of tendons are added that place the bottom half of paving tile 30 under more compressive stress than the top half. As paving tile 30 is supported by concrete material 10, this unequal compressive stress is, in some instances, beneficial.

In many types of installations it is beneficial to have a thicker layer of concrete material underneath and supporting tile 30 than elsewhere. In a curb cut installation, wet concrete 10 is formed to a sloping grade prior to the installation of tile 10, rather than being level.

In a preferred embodiment, tiles 30 are cast in 0.6 m (2 ft) by 2.4 m (8 ft) by 2.22 cm (0.875 in) sections and are cut in the shop into 0.6 m by 0.6 m, 0.75 m or 0.9 m (2 ft, 2.5 ft or 3 ft) sections. In addition, because tiles 30 are substantially uniform in cross section they may be cut at the job site to accommodate local features. For example, a vault box or a bollard may be accommodated by cutting the tile 30 into an accommodating shape. This task may be a difficult or impossible if using tiles that cannot be modified from the standard, factory provided shapes. Such tiles appear to include the wet set plastic tiles and the concrete blocks described in the background section.

The terms and expressions that have been employed in the foregoing specification are used as terms of description and not of limitation. In particular, the term concrete, wherever it is used in this application, refers to any cementitious material generally used in construction, for example a mixture of cement and sand, commonly known as "mortar" is considered to be "concrete" in this application. There is no intention, in the use of such terms and expressions, of excluding equivalents of the features shown and described or portions thereof, it being recognized that the scope of the invention is defined and limited only by the claims which follow.

The invention claimed is:

1. A method of removing a predetermined area and depth of formable material from an expanse of said formable material having a top surface, said method comprising:

(a) providing a volume indicating tool, comprising:

(i) a depth indicator that has a material surface indicator and a depth guide, said material surface indicator being at a height above said depth guide substantially equal to said predetermined depth;

(ii) a frame made up of longitudinal elements and wherein at least two of said longitudinal elements are substantially opposed, said frame indicating an area equal to said predetermined area; and (iii) wherein said depth indicator is a rib extending between substantially opposed longitudinal elements and having a top; and (b) pushing said volume indicating tool into said formable material until said material surface indicator is level with said top surface of said formable material, thereby pushing said depth guide to said predetermined depth;

(c) pushing a shovel into said formable material until it touches said rib, and running said shovel along said top of said rib to gather formable material;

(d) emptying said shovel at a location away from said volume indicating tool; and (e) repeating steps (c) and (d), until said area indicated by said area indicator is cleared of formable material down to said depth guide.

2. The method of claim 1 wherein said rib is one out of a set of ribs attached between said substantially opposed longitudinal elements.

3. A method of removing a predetermined area and depth of wet concrete from an expanse of said wet concrete having a top surface, said method comprising:

(a) providing a volume indicating tool, comprising:

(i) a depth indicator that has a material surface indicator and a depth guide, said material surface indicator being at a height above said depth guide substantially equal to said predetermined depth; and (ii) an area indicator, indicating an area equal to said predetermined area;

(b) pushing said volume indicating tool into said wet concrete until said material surface indicator is level with said top surface of said wet concrete, thereby pushing said depth guide to said predetermined depth;

(c) pushing a shovel into said wet concrete until it is at a depth equal to said depth of said depth guide and using said shovel to gather wet concrete;

(d) emptying said shovel at a location away from said volume indicating tool; and (e) repeating steps (c) and (d), until said area indicated by said area indicator is cleared of wet concrete down to said depth guide.

* * * * *